US008832975B2

(12) United States Patent
Itou et al.

(10) Patent No.: US 8,832,975 B2
(45) Date of Patent: Sep. 16, 2014

(54) BUCKET TOOTH FOR CONSTRUCTION VEHICLE

(75) Inventors: Daijirou Itou, Hirakata (JP); Takanori Nagata, Dallas, TX (US); Eiji Amada, Kyotanabe (JP); Tsuyoshi Yoshida, Tokyo (JP)

(73) Assignee: Komatsu Ltd., Tokyo (JP)

( * ) Notice: Subject to any disclaimer, the term of this patent is extended or adjusted under 35 U.S.C. 154(b) by 5 days.

(21) Appl. No.: 13/818,785

(22) PCT Filed: May 7, 2012

(86) PCT No.: PCT/JP2012/061639

§ 371 (c)(1),
(2), (4) Date: Feb. 25, 2013

(87) PCT Pub. No.: WO2012/153699

PCT Pub. Date: Nov. 15, 2012

(65) Prior Publication Data

US 2013/0152432 A1 Jun. 20, 2013

(30) Foreign Application Priority Data

May 9, 2011 (JP) ..... 2011-104556

(51) Int. Cl.
*E02F 9/28* (2006.01)

(52) U.S. Cl.
CPC ..... *E02F 9/2816* (2013.01); *E02F 9/2841* (2013.01); *E02F 9/2833* (2013.01); *E02F 9/2891* (2013.01)
USPC ..... 37/455

(58) Field of Classification Search
CPC ..... E02F 9/2825; E02F 9/2833; E02F 9/2858; E02F 9/2841; E02F 9/2816; E02F 9/2891; F16B 21/02
USPC ..... 37/446, 449, 451–460; 172/701.1–701.3; 403/150, 153, 297, 403/355; 299/109–113
See application file for complete search history.

(56) References Cited

U.S. PATENT DOCUMENTS 5,018,283 A 5/1991 Fellner
5,337,495 A * 8/1994 Pippins ..... 37/453

(Continued)

FOREIGN PATENT DOCUMENTS

CN 200955165 Y 10/2007
CN 101535574 A 9/2009

(Continued)

OTHER PUBLICATIONS

International Search Report of corresponding PCT Application No. PCT/JP2012/061639.

(Continued)

*Primary Examiner* — Robert Pezzuto
(74) *Attorney, Agent, or Firm* — Global IP Counselors, LLP

(57) ABSTRACT

A bucket tooth for a construction vehicle includes a through-hole formed in a side wall part and passing through to a cavity. The through-hole has on a cavity side a rotating body hole having a shape of a truncated and rotated cone that remains after removing a large diameter side portion obtained by cutting diagonally to a rotational axis of the truncated and rotated cone with a large diameter side of the truncated and rotated cone being disposed on the cavity side, and with the rotational axis of the truncated and rotated cone being inclined outwardly toward the distal end portion of the bucket tooth from the cavity along a width direction of the bucket tooth.

3 Claims, 5 Drawing Sheets

(56) References Cited

U.S. PATENT DOCUMENTS

| | | | | | |
|---|---|---|---|---|---|
| 5,435,084 | A | * | 7/1995 | Immel | 37/398 |
| 5,564,206 | A | * | 10/1996 | Ruvang | 37/458 |
| 5,597,260 | A | * | 1/1997 | Peterson | 403/319 |
| 5,913,605 | A | * | 6/1999 | Jusselin et al. | 37/451 |
| 6,708,431 | B2 | * | 3/2004 | Robinson et al. | 37/456 |
| 7,762,015 | B2 | | 7/2010 | Smith et al. | |
| 2004/0237354 | A1 | | 12/2004 | Emrich | |
| 2007/0000157 | A1 | | 1/2007 | Emrich | |
| 2009/0174252 | A1 | | 7/2009 | Morris et al. | |
| 2011/0099861 | A1 | | 5/2011 | Ollinger, IV et al. | |

FOREIGN PATENT DOCUMENTS

| | | | |
|---|---|---|---|
| CN | 101688385 | A | 3/2010 |
| EP | 0 472 122 | A1 | 8/1991 |
| JP | 7-243226 | A | 9/1995 |
| JP | 2009-013788 | A | 1/2009 |
| JP | 2010-526953 | A | 8/2010 |
| JP | 2011-511180 | A | 4/2011 |
| WO | 2008/140993 | A1 | 11/2008 |

OTHER PUBLICATIONS

The Chinese Office Action for the corresponding Chinese application No. 201280003483.X, issued on May 26, 2014.

* cited by examiner (a)

(b)

(a)

(b)

BUCKET TOOTH FOR CONSTRUCTION VEHICLE

CROSS-REFERENCE TO RELATED APPLICATIONS

This application claims priority to Japanese Patent Application No. 2011404556 filed on May 9, 2011, the disclosure of which is hereby incorporated herein by reference in its entirety.

FIELD OF THE INVENTION

The present invention relates to a bucket tooth that is mounted interchangeably to the distal end portion of the lower face of a construction vehicle bucket.

DESCRIPTION OF THE RELATED ART

Various kinds of excavation tool are attached to a work implement installed on a hydraulic excavator or other such work vehicle. For example, a plurality of teeth (excavation tools) are attached to the excavation-side distal end portion of a bucket (work implement) installed on a hydraulic excavator, so that the teeth protrude from the distal end portion. During excavation, these teeth function as cutting blades, which improves the excavation performance by biting into what is being excavated.

Because the teeth attached to the distal end portion on the excavation side of the bucket are pushed into the excavated material during excavation work, they wear down much faster than other parts. Therefore, the teeth are attached interchangeably to the bucket, and are replaced as needed, such as after about 1000 hours of excavation work. That is, because the teeth are replaced frequently, the work entailed by this replacement needs to be easy.

U.S. Pat. No. 7,762,015 discloses a structure in which such teeth are attached to adapters on a bucket.)

More specifically, with the tooth attachment structure disclosed in the above-mentioned publication, a protrusion (bar) provided to the side end on the adapter side is inserted into a groove provided on the tooth side, and a C-shaped locking member is rotated to fix the tooth with respect to the adapter.

SUMMARY

However, the following problems were encountered with the above-mentioned conventional tooth.

Specifically, with the tooth disclosed in the above-mentioned publication, the groove into which the locking member is inserted is disposed to the rear of the tooth-side end (a protrusion), inclined outward from the interior of the tooth in the tooth width direction, and away from the tooth distal end. Therefore, the width between teeth is relatively narrow, and a tool for rotating the locking member is used on that is approaches the locking member from near the bucket in the longitudinal direction of the tooth. In other words, with a conventional tooth structure, the space required for tooth replacement work is extremely narrow, and this makes the work harder.

It is an object of the present invention to provide a constructing vehicle bucket tooth with which the work entailed by tooth replacement is easier.

The construction vehicle bucket tooth pertaining to the first aspect is a bucket tooth for a construction vehicle, which is mounted to the distal end part of a bucket, said bucket tooth comprising an upper face, a lower force, a pair of side faces, a rear end opening, a convex side wall part, a cavity, and a through-hole. The lower face is linked the upper face at a distal end portion. The pair of side faces is formed on the sides including the distal end portion so as to link the upper face and the lower face. The rear end opening is formed on the rear side of the upper face, the lower face, and the pair of side faces, and into this rear end opening is inserted the distal end part of the bucket. The convex side wail part is provided on the rear side of one of the side faces. The cavity is provided inside the bucket tooth from the rear end opening. The through-hole is formed in the side wall and passes through to the cavity, and has on the cavity side a rotating body hole that is a hole having the shape of a truncated and rotated cone that remains after removing the large diameter side by cutting diagonally to the rotational axis a truncated and rotated cone that has a rotational axis and whose large diameter side is disposed on the cavity side, with the rotational axis of the truncated and rotated cone disposed inclined toward the distal end portion of the bucket tooth from the cavity outward along the width direction of the bucket tooth.

The above-mentioned rotated cone here refers to a three-dimensional object produced by rotating a plane figure made up of the two ends of a straight line and one point outside the straight line, using as the rotational axis an axis that links the center point of the straight line and one point outside the straight line on a perpendicular whose foot is this center point. A line segment that includes one point outside the straight line and cut from a plane including the rotational axis of this rotated cone is called a generatrix.

Consequently, when a bucket tooth is being attached or removed, the side wall side of the through-hole can be accessed from the tooth front side in the longitudinal direction of the tooth. Thus, during tooth replacement, the through-hole can be accessed from the side with a large space (on which there is no bucket), so the job is easier to complete.

The bucket tooth for a construction vehicle pertaining to the second aspect is the bucket tooth for a construction vehicle pertaining to the first aspect, wherein the through-hole further has a concave opening that is linked to the rotating body hole and is disposed on the side wall side. The opening has a flat opening bottom face that is inclined toward the front of the bucket tooth and perpendicular to the rotational axis of the truncated and rotated cone from the side wall surface of the bucket tooth.

Consequently, dirt that accumulates in the opening during work can be easily removed, which means that replacing the tooth takes less time.

The bucket tooth for a construction vehicle pertaining to the third aspect is the bucket tooth for a construction vehicle pertaining to the first or second aspect, wherein the truncated and rotated cone is such that an edge portion in a cross section cut along a plane that includes the rotational axis of the truncated and rotated cone is a straight line.

Consequently, the generatrix of the truncated and rotated cone is a straight line, and this results in a truncated and rotated cone. Making the through-hole a truncated and rotated cone makes it easier to machine the through-hole and improves reliability of the bucket attachment structure.

The work entailed by tooth replacement is made easier with the construction vehicle bucket tooth pertaining to the present invention.

DESCRIPTION OF THE EMBODIMENTS

First Embodiment

A tooth 2 pertaining to an embodiment of the present invention will be described through reference to FIGS. 1 to 4*b*, while also referring to the attachment structure to a bucket 1.

Figure 1:
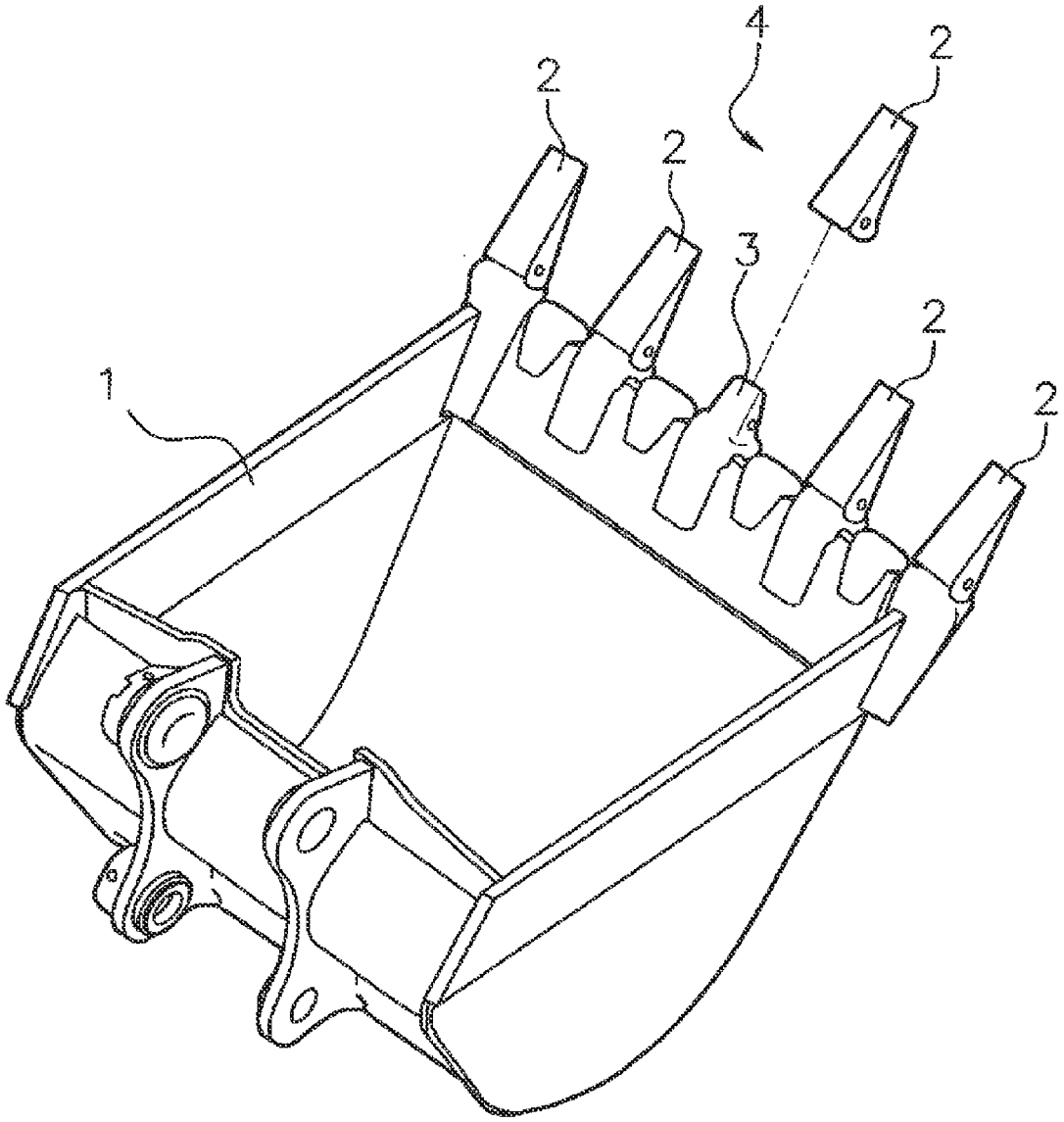
FIG. 1 is an oblique view of the construction vehicle bucket tooth pertaining to an embodiment of the present invention, and the surrounding area thereof.

As shown in FIG. 1, the teeth 2 of a bucket 1 pertaining to this embodiment are attached to a plurality of adapters 3 provided to the distal end (the upper-right end in FIG. 1) of the lower face (the excavation side) of the bucket 1. These teeth 2 are replaced when they are worn down by work.

In this embodiment, a bucket tooth assembly corresponds to a tooth 2, and is an assembled part in which a latching member 4 is mounted to a main body part 2*a* (discussed below), and can be attached directly to an adapter 3 of the bucket 1.

Teeth 2

Figure 2:
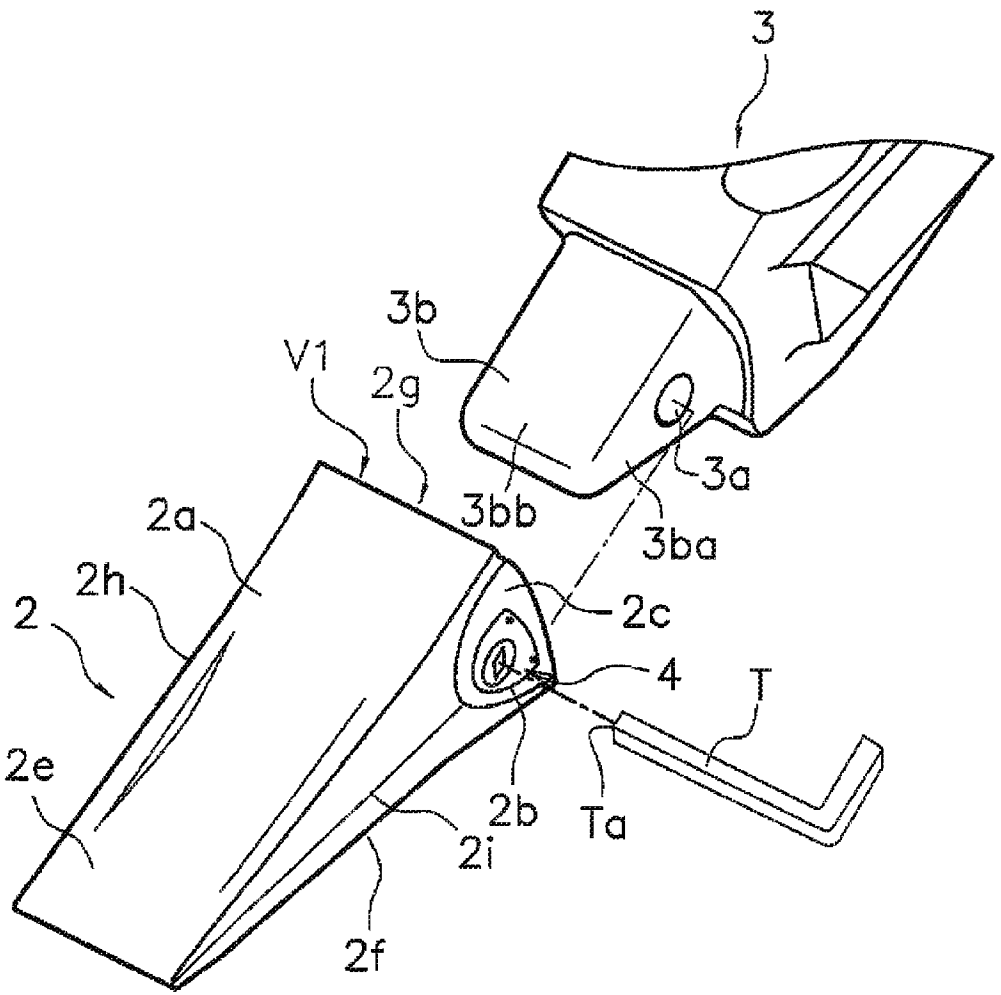
FIG. 2 is an exploded oblique view showing in detail the attachment portion of the bucket tooth assembly in FIG. 1.
Figure 3:
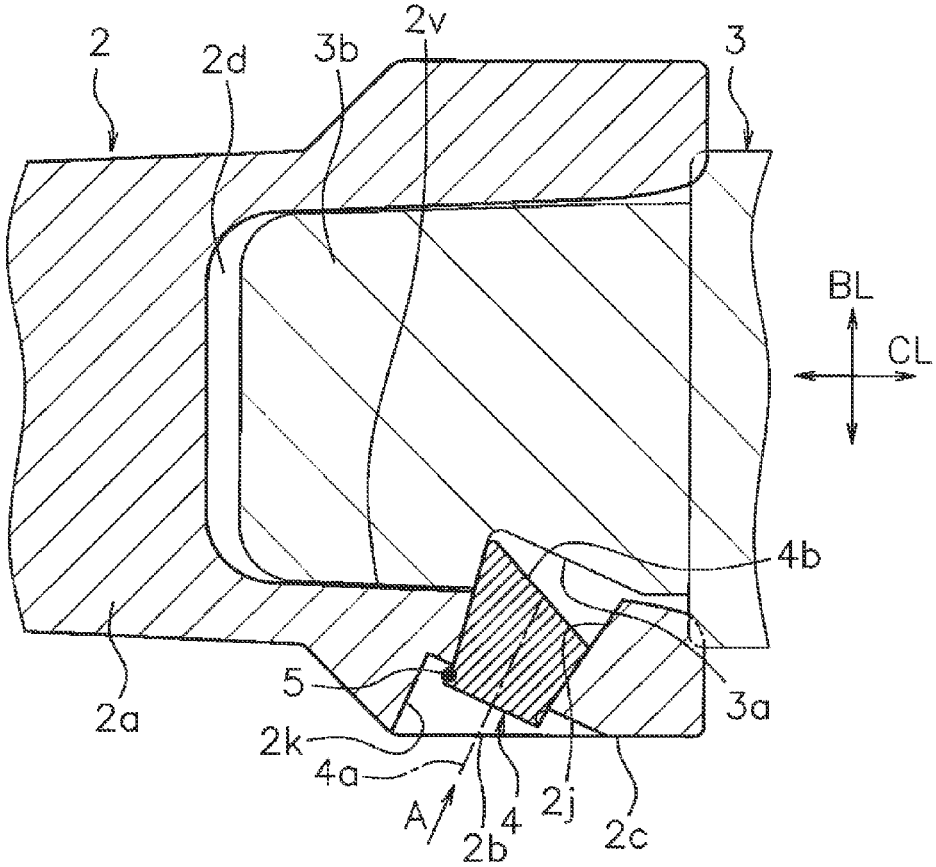
FIG. 3(*a*) is a detail cross section of the joined portion of an adapter and a bucket tooth, and FIG. 3(*b*) is a plan view of the latching member in FIG. 3(*a*) as seen in the axial direction.
Figure 3:
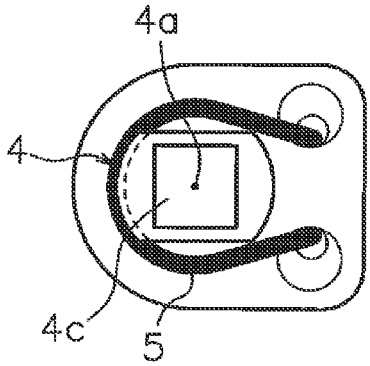
Figure 4:
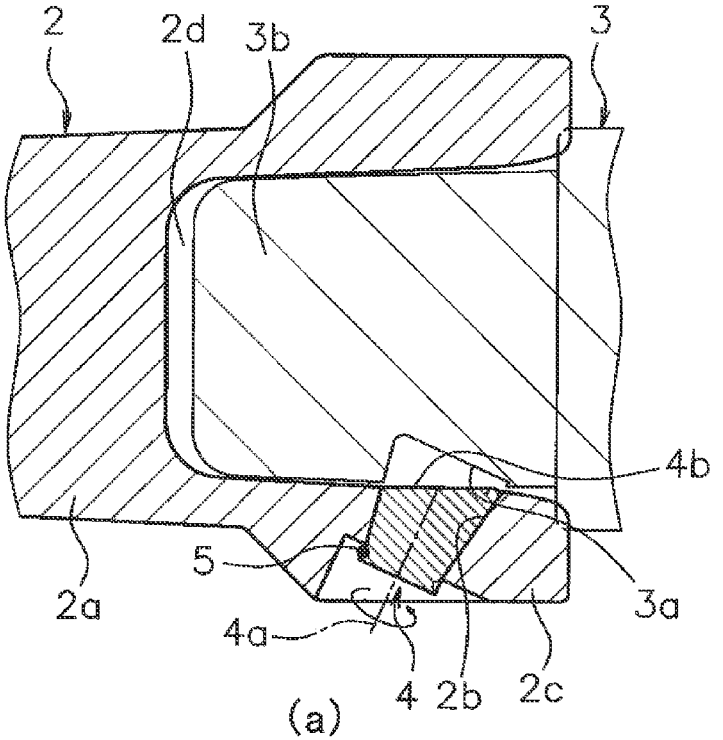
FIGS. 4(*a*) and 4(*b*) are detail cross sections showing the switching between a latched state and an unlatched state by rotating the latching member provided to the joined portion of an adapter and a bucket tooth.
Figure 4:
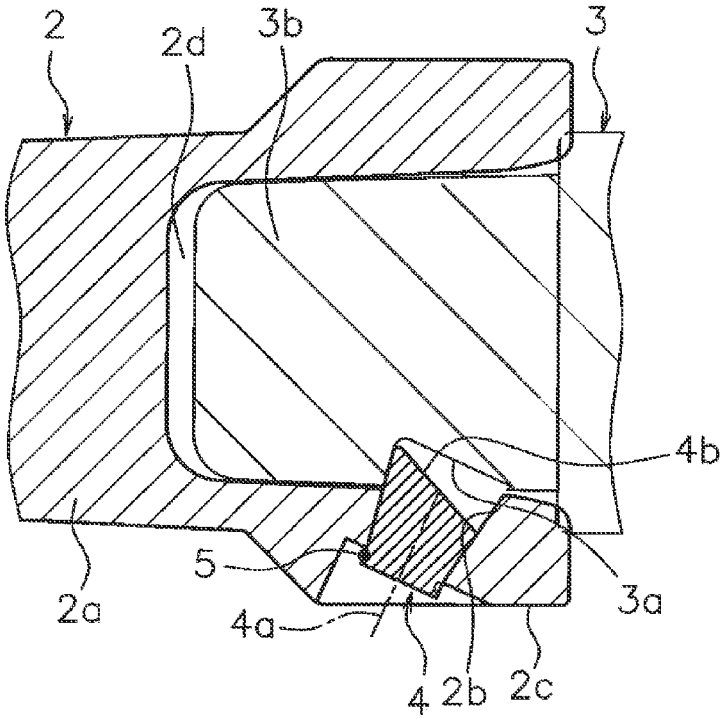

As shown in FIG. 2, the tooth 2 is a prong-like member attached to the distal end of the excavation portion of the bucket 1 in order to perform excavation with the bucket 1, and has a wedge-like outer shape that tapers toward the distal end. As shown in FIG. 2, the tooth 2 has the main body part (bucket tooth) 2*a*, a through-hole 2*b*, a side wall 2*c*, a contact face 2*d* (see FIG. 3*a*), and a cavity V1.

The main body part 2*a* has outer faces made up of an upper face 2*e* and lower face 2*f* that are substantially rectangular and are linked at their distal ends, substantially triangular side faces 2*h* and 2*i* that are between the upper face 2*c* and the lower face 2*f* and include the above-mentioned distal ends, and a substantially rectangular rear end face 2*g* that is formed by the rear ends of the side faces 2*h* and 2*i*, the upper face 2*e*, and the lower face 2*f*. The rear end face 2*g* has an opening and continues to the cavity V1. The cavity V1 is formed by an inner face 2*v* that is on the inside of the main body part 2*a*.

The cavity V1 is a concave space fanned in the interior of the main hod part 2*a* from the rear end face 2*g* of the tooth 2 toward the distal end. This concave space is shaped like a wedge, tapering toward the distal end just as the tooth 2 does. An insertion portion 3*b* of the adapter 3 (discussed below) is inserted into this cavity V1.

The side wall 2*c* is a convex portion that sticks out on the rear side of the side faces 2*h* and 2*i*. The side wall 2*c* forms the side faces of the cavity V1 formed in the interior of the main body-part 2*a*, and the through-hole 2*b* (discussed below) is formed on one side (the side face 2*i*).

The through-hole 2*b* has a concave opening 2*k* that is provided to the side wall 2*c* and opens to the outside, and a rotating body hole 2*j* that is smaller in diameter than this opening 2*k* and into which the latching member 4 is inserted (discussed below). The through-hole 2*b* goes from the side face 2*i* on one side of the main body part 2*a* into the cavity V1, and is formed inclined in the width direction of the tooth 2 (the BL direction in FIG. 3*a*) from the cavity V1 side outward toward the distal end of the tooth 2. The latching member 4 (discussed below) is inserted into the through-hole 2*b* from the cavity V1 side.

The rotating body hole 2*j* of the through-hole 2*b* is a space having the shape of part of a truncated and rotated cone.

The rotated cone here refers to a three-dimensional object produced by rotating a plane figure made up of the two ends of a straight line and one point outside the straight line, using as the rotational axis a line that links the center point, of this straight line and one point outside the straight line on a perpendicular whose foot is this center point. The term "truncated and rotated cone" refers to a three-dimensional object on the side including the bottom face when a rotated cone is cut in a plane parallel to the bottom face (the face produced by rotation of the straight line). The small diameter side of this space is on the side wall 2*c* side of the tooth 2, and the large diameter side is on the cavity V1 side. The rotational axis of the truncated and rotated cone going from the large diameter side to the small diameter side (the same as the center axis of the rotating body hole 2*j* of the through-hole 2*b*; hereinafter referred to as the center axis of the through-hole 2*b*) is disposed so as to be inclined toward the distal end of the tooth 2 from the width direction of the tooth 2 (the BL direction in FIG. 3*a*). The rotating body hole 2*j* has the shape of a truncated and rotated cone that remains after removing the bottom face by cutting diagonally to the rotational axis from a point on the periphery of the bottom face of a truncated and rotated cone disposed inclined to the side wall 2*c*. Since the rotational axis is inclined as discussed above, the rearmost point of the through-hole 2*b* on the cavity side corresponds to the above-mentioned point on the periphery of the bottom face. The through-hole 2*b* has an inside diameter that is larger by a play amount at the corresponding location than the outside diameter of the latching member 4 (discussed below). This rotated cone is a conical body in which the generatrix (the edge of a plane including the rotational axis of the rotated cone) is a straight line. The shape of the remaining portion besides the above-mentioned rotating body hole 2*j* of the truncated and rotated cone shall be considered to be the shape of the rest of the truncated cone.

The opening 2*k* of the through-hole 2*b* is provided on the side wall 2*c* side of the through-hole 2*b*, and continues to the rotating body hole 2*j*. This opening 2*k* is formed by an opening bottom face 2*m* that is perpendicular to the rotational axis 4*a* of the rotating body hole, and a parallel opening side face 2*n*. Because the center axis of the through-hole 2*b* is inclined as mentioned above, the opening bottom face 2*m* is formed as a plane that forms a groove inclined in the tooth distal end direction from the surface of the side wall 2*c*, from the rear side toward the front side in the longitudinal direction of the tooth (the CL direction in FIG. 3*a*). The opening side face 2*n* is formed perpendicular from this front side. A cross section of the opening 2*k* at a plane in the tooth width direction (the BL direction in FIG. 3*b*) that includes the center axis of the through-hole 2*b* has a right triangular shape whose side is approximately on the side wall 2*c*, as shown in FIG. 3*a*. Consequently, dirt that accumulates in the opening 2*k* during work can be easily removed, which means that replacing the tooth takes less time.

The contact face 2*d* is part of the inner face 2*v*, is an inner wall face disposed in a V shape that forms the cavity V1 inside the main body part 2*a*, and comes into contact with a contact face 3*bb* on the adapter 3 side (discussed below). Here, a state in which the contact face 2*d* of the tooth 2 is in contact with the contact face 3*bb* of the adapter 3 is a state in which the adapter 3 has been inserted as far as it will go into the tooth 2. This state will hereinafter be called a contact state.

Adapter 3

As shown in FIG. 1, a plurality of the adapters 3 are provided to the lower face end of the bucket 1, and the above-mentioned teeth 2 are attached to these adapters. As shown in FIG. 2, the adapter 3 has a concave portion 3*a* and the insertion portion 3*b*.

The concave portion 3*a* is a bottomed groove, and is formed on one side face (the side wall 3*ba*) of the insertion portion 3*b* of the adapter 3. This concave portion 3*a* has the shape of the rest of the truncated and rotated cone, and when the tooth 2 is mated in a contact state with the adapter 3, a single completed space is formed in a substantially truncated and rotated conical shape, which communicates with part (the insertion portion 2*j*) of the substantially truncated and rotated conical space of the through hole 2*b* of the tooth 2. The bottom of the concave portion 3*a* is the bottom face on the large diameter side of the substantially truncated and rotated conical space thus completed, and the part of the bottom of the concave portion 3*a* that is farthest to the rear end side of the tooth is substantially located on the side wall 3*ba* of the adapter 3. Therefore, the concave portion 3*a* is made up of a face having the curved face of an approximate truncated and rotated cone on the distal end side of the tooth 2, and the flat face of an approximate truncated and rotated cone on the rear end side of the tooth 2. The latching member 4 inserted into the through-hole 2*b* is rotated to insert or retract part (the bottom part 4*b*) of the latching member 4.

In other words, a state in which the bottom part 4*b* of the latching member 4 is inserted into the concave portion 3*a* means a latched state of the tooth 2. Conversely, a state in which the bottom part 4*b* of the latching member 4 has been retracted from inside the concave portion 3*a* so that the entire latching member 4 is now housed inside the through-hole 2*b* means an unlatched state of the tooth 2.

The insertion portion 3*b* is formed to match the shape of the cavity V1 formed inside the tooth 2, and is inserted into the cavity V1 formed in the interior of the tooth 2. In a state in which the tooth 2 has been mounted to the adapter 3, if a load is exerted on the tooth 2 during work or the like, the contact face 2*d* of the tooth 2 where the cavity V1 is formed comes into contact with the contact face 3*bb* of the insertion 3*h* on the adapter 3 side, and this load is borne by the adapter 3. Consequently, a load exerted on the tooth 2 during work or the like is not exerted on the latching member 4 (discussed below).

The contact face 3*bb* is an outer wall face of the insertion portion 3*b* that comes into contact with the contact face 2*d* on the tooth 2 side in a state in which the tooth 2 has been attached. As discussed above, the contact face 3*bb* receives a load exerted on the tooth 2 during work, at a face on the adapter 3 side.

Latching Member 4

The latching member 4 is a substantially truncated and rotated conical member that is attached so that the tooth 2 will not fall off the adapter 3. As shown in FIG. 2, the latching member 4 is inserted into the through-hole 2*b* on the tooth 2 side from the cavity V1 side. As shown in FIG. 3*a*, the latching member 4 has a latching member main body with a substantially truncated and rotated conical shape, a rotational axis 4*a* of this latching member main body (the rotational axis of the latching member), the bottom part 4*b*, and a tool insertion portion 4*c*.

The rotational axis 4*a* of the latching member 4 here is the same as the center axis of the through-hole 2*b* into which the latching member 4 is inserted, and the latching member 4 is able to rotate within the through-hole 2*b*.

As shown in FIG. 4*a*, the shape of the main body of the latching member 4 is the shape of the space on the through-hole 2*b* side of a truncated and rotated conical space obtained by cutting the completed truncated and rotated conical space formed by the through-hole 2*b* of the tooth 2 and the concave portion 3*a* of the adapter 3 in a contact state, at the face of the tooth 2 in which the cavity V1 is formed. In other words, the main body of the latching member 4 has a shape that is similar to that of the truncated and rotated conical space in the through-hole 2*b* of the tooth 2 but that is small enough to allow for play, and substantially has the shape of the above-mentioned part of a truncated and rotated cone. The rearmost position of the tooth 2 in a cross section is substantially equal to the rearmost position of the bottom part of the truncated and rotated conical space. The rotational axis 4*a* of the main body of the latching member 4 is the same as the rotational axis of the truncated and rotated conical space formed by the through-hole 2*b* and the concave portion 3*a*.

The rotational axis 4*a* is the rotational center when the latching member 4 is rotated inside the through-hole 2*b* using a tool T (see FIG. 2).

As shown in FIG. 3*a*, the bottom part 4*b* is formed at an angle to the rotational axis 4*a* of the substantially truncated and rotated conical latching member 4, because of the different length of the outer peripheral face generatrix) of the latching member 4 having a substantially truncated and rotated conical external shape in cross sectional view. As discussed above, the bottom part 4*b* of the latching member 4 at a specific rotational position is in the same plane as the inner face of the tooth 2 that forms the cavity V1. When the latching member 4 is rotated 180 degrees from this specific rotational position, the part of the latching member 4 that was at the rearmost location of the tooth 2 moves from the cavity face of the tooth 2 to a position on the distal end side of the tooth 2 of the bottom part of the concave portion 3*a*, and the adapter 3 engages with the latching member 4. Consequently, it is possible to switch between a state in which part (the bottom part 4*b*) of the latching member 4 is inserted into the concave portion 3*a* on the adapter 3 side (latched state) and a state in which it is retracted from inside the concave portion 3*a* (unlatched state) merely by rotating the latching member 4 around the rotational axis 4*a*.

The tool insertion portion 4*c* is provided to a face that is perpendicular to the rotational axis 4*a* at a location extended from the small diameter side of the substantially truncated and rotated conical shape on the latching member 4, and is disposed within the opening 2*k* of the through-hole 2*b*. This tool insertion portion 4*c* is a groove into which is inserted the distal end part Ta of the tool T (see FIG. 2) used to rotate the latching member 4 manually, and is formed in a shape that matches the shape of the distal end part Ta of the tool T (a square shape in FIG. 3*b*). A groove is provided to part of the outer periphery of the extended location, and a C-ring 5 (discussed below) is installed in this groove. FIG. 3*b* is a view of the area around the through-hole 2*b* from the viewpoint A in FIG. 3*a*.

When the tooth 2 is replaced, the tool T must be brought close to the tool insertion portion 4*c*. In this embodiment, the tool T accesses the rotational axis 4*a* along the rotational axis 4*a* of the through-hole 2*b*, that is, from ahead of the tooth 2 in the longitudinal direction of the tooth 2. Specifically, the tool is brought in through the space that is open because the bucket 1 is not there. This makes the job of replacing the tooth 2 easier than in the past.

In this embodiment, the C-ring 5 (anti-rotation member), which stops rotation of the latching member 4, is provided so that the latching member 4 will not unintentionally rotate due to vibration, impact, or the like during work with the construction vehicle, except when the tool T is used to rotate the latching member 4 manually.

The C-ring 5 is a member formed in a U shape from rubber or another such elastic member, and is snugly fitted into the groove provided to the outer peripheral face of the latching member 4. The two ends of the C-ring 5 are fixed to the side wall 2*c*. The latching member 4 fits snugly against the C-ring 5, and this prevents rotation away from the specified position by friction.

Consequently, it is possible to prevent the latched state of the tooth 2 with respect to the adapter 3 from being released to the unlatched state as a result of the latching member 4 being unintentionally rotated by vibration or the like during work

Switching of Tooth 2 Between Latched State and Unlatched State

In this embodiment, because of the configuration discussed above, the tooth 2 is switched between a latched state (second state and an unlatched state (first state) with respect to the adapter 3, Specifically, as shown in FIG. 4*a*, when the tooth 2 is attached to the adapter 3, let us assume a state in which part (the bottom part 4*b*) of the latching member 4 inserted into the through-hole 2*b* of the tooth 2 has not moved into the concave portion 3*a* on the adapter 3 side, and is instead housed in the through-hole 2*b* (unlatched state). If at this point this unlatched state does not exist in the attachment of the tooth 2, the tool T may be used to rotate the latching member 4 and create an unlatched state.

Consequently, the insertion portion 3*b* of the adapter 3 can be inserted into the interior of the cavity V1 in the tooth 2.

Next, in a state in which the insertion portion 3*b* of the adapter 3 has been inserted into the cavity V1 of the tooth 2, the tool is used to rotate the latching member 4 180 degrees from the unlatched state, and as shown in FIG. 4*b*, this changes to a state in which part (the bottom part 4*b*) of the latching member 4 is has moved into the concave portion 3*a* on the adapter 3 side (latched state).

The bottom part 4*b* of the each member 4 that has moved into the concave portion 3*a* on the adapter 3 side is such that when a three is exerted on the tooth 2 that moves it away from the adapter 3, part of the latching member 4 moving integrally with the tooth 2 is caught inside the concave portion 3*a* of the adapter 3. This creates a latched state in which the tooth 2 does not fall off the adapter 3.

Conversely, when a force is exerted (such as during excavation) in the direction of pushing the tooth 2 to the adapter 3 side (to the right, or the CL direction, in FIG. 3*a*), the heavy load exerted on the tooth 2 during work is borne by both the contact face 2*d* on the tooth 2 side and the conduct face 3*bb* on the adapter 3 side, so the latching member 4 is not subjected to a load with this configuration. In this embodiment, the adapter 3 and the latching member 4 are in contact in the contact state between the tooth 2 and the adapter 3, but the load exerted on the tooth 2 is borne by the contact faces 2*d* and 3*bb*, and no load is exerted on the latching member 4. Also, even if wear of the contact faces 2*d* and 3*bb* should cause the tooth 2 to be pushed more to the rear end side beyond the pre-wear position, the latching member 4 will move away from the adapter 3 and will not be in contact with the adapter 3. Therefore, again, a load pushing the tooth 2 toward the adapter 3 is not exerted on the latching member 4. Thus, the latching member 4 only needs to have the function of latching the tooth 2 so that it does not fall off the adapter 3, so damage to the latching member 4 caused by load exerted on the tooth 2 during work can be prevented. As a result, a longer service life can be ensured for parts in the attachment structure portion of the tooth 2, while the tooth 2 can be switched between a latched state and an unlatched state by a simple configuration. Also, since the switching between the state and unlatched state can be accomplished merely by rotating the latching member 4, the job of attaching and removing the tooth 2 to and from the adapter 3, that is, the job of replacing the tooth 2, can be performed more easily.

Second Embodiment

The teeth on a construction vehicle pertaining to another embodiment of the present invention will now be described through reference to FIGS. 5*a* and 5*b*.

In this embodiment, a bolt 55 (anti-rotation member) that stops rotation of a latching member 54. Which rotates around a rotational axis 54*a* and in the outer peripheral face of which is formed a groove 54*e*, is used as shown in FIGS. 5*a* and 5*b* instead of using the C-ring 5 of the above embodiment as an anti-rotation member that stops rotation of the latching member 4. This embodiment differs from the first embodiment above in that whereas in the first embodiment the opening of the through-hole had an opening bottom face, and a cross section of this opening was substantially shaped like a right triangle, in this embodiment the opening does not have a bottom face.

Figure 5:
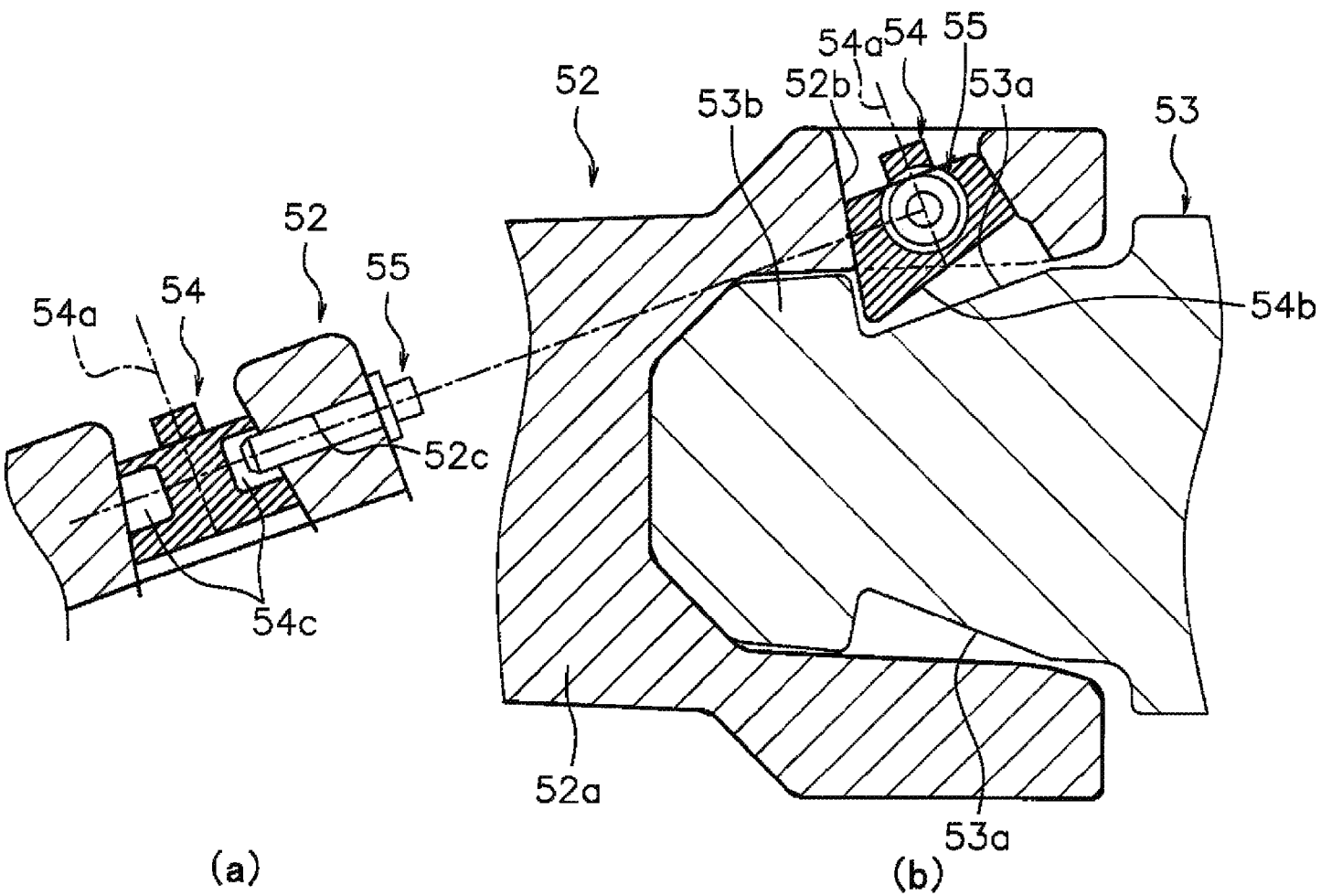
FIG. 5(*a*) is a detail cross section of the configuration around the latching member provided to the joined portion of an adapter and a construction vehicle bucket tooth in another embodiment of the present invention, and FIG. 5(*b*) is a detail cross section of when the angle at which the latching member is viewed has been changed by 90 degrees.

FIG. 5*b* is a detail cross section of the area around the latching member, in a plane that includes the width direction and the longitudinal direction of the tooth, with the bolt 55 shown superposed for the sake of illustration.

As shown in FIG. 5*b*, in this embodiment the bottom part 54*b* of the latching member 54 can be moved in and out of the concave portion 53*a* of the adapter 53 by rotating the latching member 54 around the rotational axis 54*a* in a state in which the insertion portion 53*b* of the adapter 53 has been inserted into the interior of the main body part 52*a* of the tooth 52. The bolt 55 is inserted into a bolt hole 52*c* formed in the side face of the main body part 52*a* in order to stop rotation of the latching member 54 in a state in which the main body part 52*a* of the tooth 52 has been latched to the adapter 53 by the latching member 54. If the bolt 55 is inserted all the way in, the distal end of the bolt 55 moves into the groove 54*c* formed in the outer peripheral face of the latching member 54. As shown in FIG. 5*a*, the groove 54*e* here is provided at two opposing places on the outer peripheral face of the latching member 54.

Consequently, the latching member 54 can be put in a state in which it cannot rotate around the rotational axis 54*a* by inserting the distal end of the bolt 55 into the groove 54*c*.

As shown in FIG. 5*b*, a concave portion 53*a* is preferably provided on the left and right side faces of the adapter 53.

As a result, no matter which side face of the main body part 52*a* of the tooth 52 the through-hole 52*b* is provided to, the tooth 52 can be latched to the adapter 53 by the latching member 54. Thus, teeth 52 with different shapes can be attached, and parts can be shared.

Other Embodiments

Embodiments of the present invention were described above, but the present invention is not limited to or by the above embodiments, and various modifications are possible without departing from the gist of the invention.

(A) in the above embodiment, an example was given in which the shape of the rotating body hole 2*j* was that of a cone in which the generatrix of a rotating body was a straight line, but the present invention is not limited to this.

For example, the generatrix of a rotating body of the above-mentioned rotating body hole may be a curve, so long as the latching member allows the insertion and removal of an insertion portion.

The bucket tooth of a construction vehicle of the present invention can be widely applied to attachment structures for various kinds of excavation tool used for mounting to a bucket.

The invention claimed is:

1. A bucket tooth for a construction vehicle, which is mounted to a distal end part of a bucket, the bucket tooth comprising:

an upper face;

a lower face linked to the upper face at a distal end portion;

a pair of side faces formed on sides including the distal end portion so as to link the upper face and the lower face;

a rear end opening formed on a rear side of the upper face, the lower face, and the pair of side faces, and into which is inserted the distal end part of the bucket;

a convex side wall part provided on the rear side of one of the side faces;

a cavity extending inside the bucket tooth from the rear end opening; and a through-hole formed in the side wall part and passing through to the cavity, and the through-hole having on a cavity side a rotating body hole having a shape of a truncated and rotated cone that remains after removing a large diameter side portion obtained by cutting diagonally to a rotational axis of the truncated and rotated cone with a large diameter side of the truncated and rotated cone being disposed on the cavity side, and with the rotational axis of the truncated and rotated cone being inclined outwardly toward the distal end portion of the bucket tooth from the cavity along a width direction of the bucket tooth.

2. The bucket tooth for a construction vehicle according to claim 1, wherein the through-hole further has a concave opening linked to the rotating body hole and is disposed on a side of the side wall part, and the concave opening has a flat opening bottom face that is inclined toward a front portion of the bucket tooth and perpendicular to the rotational axis of the truncated and rotated cone from a surface of the side wall part of the bucket tooth.

3. The bucket tooth for a construction vehicle according to claim 1, wherein the rotating body hole is arranged such that an edge portion of the truncated and rotated cone in a cross section cut along a plane that includes the rotational axis of the truncated and rotated cone is a straight line.

* * * * *